United States Patent [19]

Spars et al.

[11] 4,332,669

[45] Jun. 1, 1982

[54] OIL SHALE RETORTING PROCESS WITH RAW SHALE PREHEAT PRIOR TO PYROLYSIS

[75] Inventors: Byron G. Spars, Mill Valley; Paul W. Tamm, Oakland; P. H. Wallman, Berkeley, all of Calif.

[73] Assignee: Chevron Research Company, San Francisco, Calif.

[21] Appl. No.: 153,509

[22] Filed: May 27, 1980

[51] Int. Cl.[3] ..... C10G 1/02

[52] U.S. Cl. ..... 208/11 R

[58] Field of Search ..... 208/11 R

[56] References Cited

U.S. PATENT DOCUMENTS

| | | | |
|---|---|---|---|
| 2,285,276 | 6/1942 | Hemminger | 208/11 R |
| 3,784,462 | 1/1974 | Frick | 208/11 R |
| 3,972,801 | 8/1976 | Gregoli | 208/11 R |
| 3,976,558 | 8/1976 | Hall | 208/11 R |

*Primary Examiner*—T. Tufariello

*Attorney, Agent, or Firm*—J. A. Buchanan, Jr.; D. A. Newell

[57] ABSTRACT

Disclosed is an improved process for retorting oil shale in a staged turbulent bed retort wherein the raw shale feed particles are classified and deaerated into first and second fractions, said first fraction containing substantially only shale particles above about 25 mesh. The first fraction is then preheated with hot shale fines in a dilute phase lift pipe prior to retorting.

8 Claims, 1 Drawing Figure

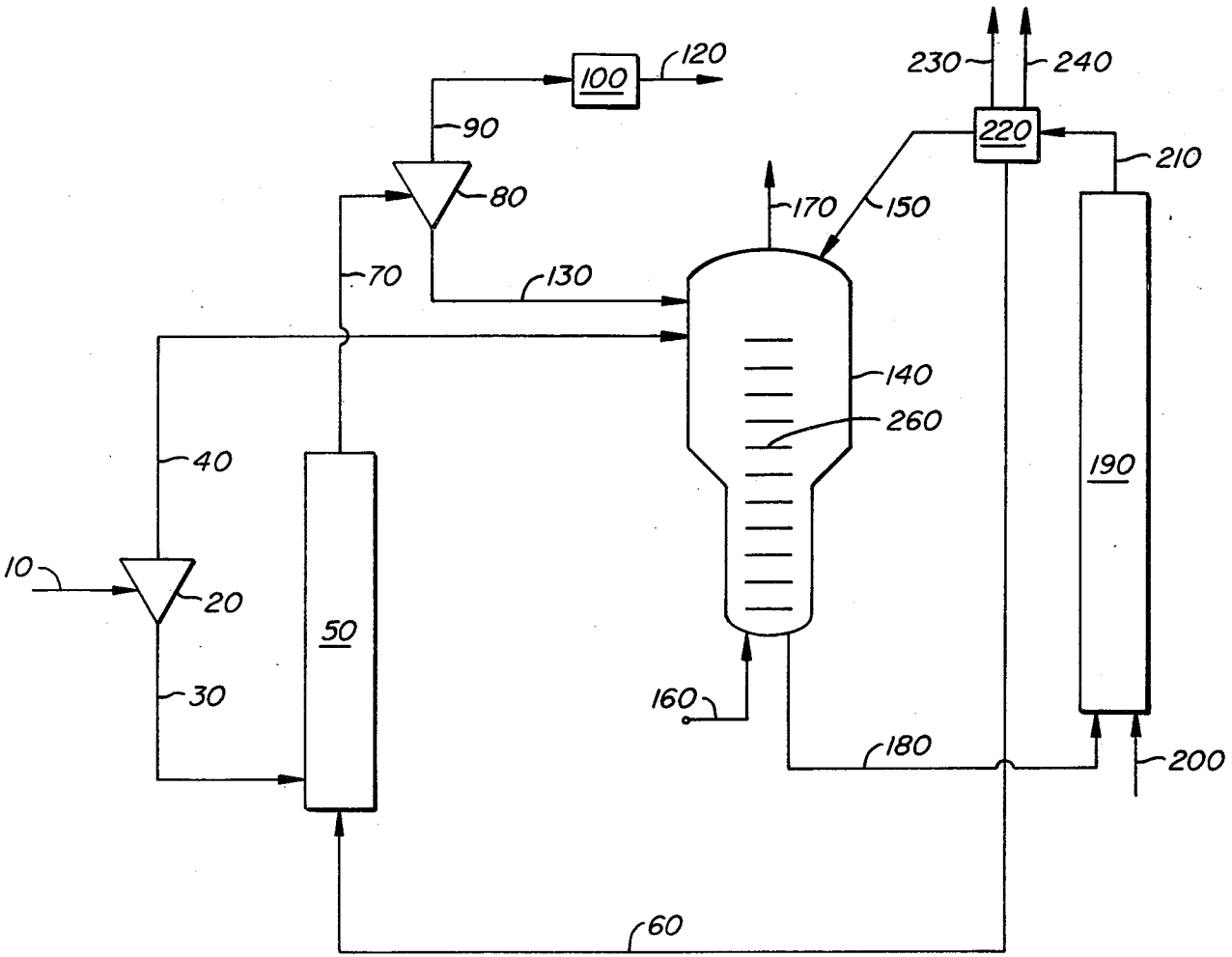
10
20
30
40
50
60
70
80
90
100
120
130
140
150
160
170
180
190
200
210
220
230
240
260

OIL SHALE RETORTING PROCESS WITH RAW SHALE PREHEAT PRIOR TO PYROLYSIS

BACKGROUND OF THE INVENTION

1. Field of the Invention

The present invention relates to the retorting of oil shale in a staged turbulent bed with raw shale preheat.

2. Description of the Prior Art

Vast natural deposits of shale in Colorado, Utah and Wyoming contain appreciable quantities of organic matter which decompose upon pyrolysis to yield oil, hydrocarbon gases and a carbonaceous residue. The organic matter or kerogen content of these deposits has been estimated to be equivalent to approximately 500 million cubic meters of oil. As a result of the dwindling supplies of petroleum and natural gas, extensive research efforts have been directed to develop retorting processes which will economically produce shale oil on a commercial basis from these vast resources.

In principle, shale retorting simply comprises heating the raw shale to an elevated temperature and recovering the vapors evolved. The process heat requirements may be supplied either directly or indirectly. Directly heated retorting processes rely upon the combustion of fuel in the presence of the oil shale to provide sufficient heat for retorting. Such processes result in lower product yields, due to unavoidable combustion of some of the product, and dilute the product stream with the products of combustion. Indirectly heated retorting processes generally use a separate furnace or equivalent vessel in which a solid or gaseous heat carrier is heated. The hot heat carrier is subsequently mixed with the shale to provide heat, thus resulting in higher yields while avoiding dilution of the retort products with combustion products.

As used herein, the term "oil shale" refers to fine-grained sedimentary material which is predominantly clay, carbonates and silicates in conjunction with organic matter composed of carbon, hydrogen, sulfur, oxygen, and nitrogen, called "kerogen".

The term "retorted shale", as used herein, refers to oil shale from which essentially all of the volatizable hydrocarbons have been removed, but which may still contain carbonaceous residue.

The term "spent shale", as used herein, refers to retorted shale from which a substantial portion of the carbonaceous residue has been removed, for example by combustion in a combustion zone.

The terms "condensed", "noncondensable", "normally gaseous", or "normally liquid" are relative to the condition of the subject material at a temperature of 25° C. (77° F.) and a pressure of one atmosphere.

Particle size, unless otherwise indicated, is measured with respect to Tyler Standard Sieve sizes.

In the staged turbulent bed retorting process, crushed raw oil shale particles are introduced by conventional means, into an upper portion of a retort, and passed downwardly therethrough. Spent shale, at an elevated temperature, is also introduced by conventional means into the upper portion of said retort and passes downwardly therethrough cocurrently with the raw crushed oil shale. The maximum particle size for the shale introduced is maintained at or below 2½ mesh, Tyler Standard Sieve size. Particle sizes in this range are easily produced by conventional means such as cage mills, jaw, or gyratory crushers. The crushing operations can be conducted to produce a maximum particle size, but little or no control can be effected over the smaller particle sizes produced. This is particularly true in regard to the crushing of shale which tends to cleave into slab or wedged-shape fragments.

The temperature of the spent shale introduced to the retort will normally be in the range of 600° C.–800° C., and an appropriate operating ratio of hot spent shale to raw shale may be selected to maintain the temperature at the top of the retort in the broad range, 450° C. to 540° C., and preferably in the range of 480° C. to 510° C.

The weight ratio of spent shale heat carrier to raw oil shale may be varied from approximately 1.0:1 to 8:1, with a preferred weight ratio in the range of 2.0:1 to 3:1. It has been observed that some loss in product yield occurs at the higher weight ratios of spent shale to fresh shale and it is believed that the cause for such loss is due to increased adsorption of the retorted hydrocarbonaceous vapor by the larger quantities of spent shale. Furthermore, attrition of the spent shale, which is a natural consequence of retorting and combustion of the shale, occurs to such an extent that high recycle ratios cannot be achieved with spent shale alone. If it is desired to operate at the higher weight ratios of heat carrier to fresh shale, an auxiliary attrition resistant material, such as sand, must be substituted as part or all of the heat carrier.

The mass flow rate of fresh oil shale through the retort should be maintained between 4,900 kg/hr-m$^2$ and 29,300 kg/hr-m$^2$, and preferably between 9,800 kg/hr-m$^2$ and 19,600 kg/hr-m$^2$. Thus, in accordance with the broader recycle heat carrier weight ratios stated above, the total solids mass rate will range from approximately 12,200 kg/hr-m$^2$ to 261,000 kg/hr-m$^2$.

A stripping gas, preferably steam, is introduced into a lower portion of the retort and passes upwardly through the vessel in countercurrent flow to the downwardly moving shale. The flow rate of the stripping gas should be maintained so as to produce a superficial gas velocity at the bottom of the vessel in the range of approximately 30 cm per second to 150 cm per second, with a preferred superficial velocity in the range of 30 cm per second to 60 cm per second. The stripping gas may be comprised of steam, recycle product gas, hydrogen or any inert gas. It is particularly important, however, that the stripping gas selected be essentially free of molecular oxygen to prevent product combustion within the retort.

The stripping gas will fluidize those particles of the raw oil shale and spent shale heat carrier having a minimum fluidization velocity less than the velocity of the stripping gas. Those particles having a fluidization velocity greater than the gas velocity will pass downwardly through the retort, generally at a faster rate than the fluidized particles.

Limiting the vertical backmixing of the downwardly moving shale and heat carrier by mechanical means produces stable, substantially plug flow conditions throughout the retort volume. True plug flow, wherein there is little or no vertical backmixing of solids, allows much higher conversion levels of kerogen to vaporized hydrocarbonaceous material than can be obtained, for example, in a fluidized bed retort with gross top to bottom mixing. In conventional fluidized beds or in stirred tank type reactors, the product stream removed approximates the average conditions in the conventional reactor zone. Thus, in such processes partially retorted material is necessarily removed with the product stream, resulting in either costly separation and recycle of unreacted materials, reduced product yield, or a larger reactor volume giving much longer average particle residence times. Maintaining substantially plug flow conditions by substantially limiting top to bottom mixing of solids, however, allows one to operate the process on a continuous basis with a much greater control of the residence time of individual particles. The use of mechanical means for limiting substantial vertical backmixing of solids also permits a substantial reduction in size of the retort zone required for a given mass throughput, since the chances for removing partially retorted solids with the retorted solids are reduced. The mechanical means for limiting backmixing and limiting the maximum bubble size may be generally described as barriers, baffles, dispersers or flow redistributors, and may, for example, include spaced horizontal perforated plates, bars, screens, packing, or other suitable internals.

Gross vertical backmixing should be avoided, but highly localized mixing is desirable for purposes of heat transfer in that it increases the degree of contacting between the solids and the solids and gases. The degree of backmixing is, of course, dependent on many factors, but is primarily dependent upon the particular internals or packing disposed within the retort.

A product effluent stream comprised of hydrocarbonaceous material admixed with the stripping gas and some entrained fines is removed from the upper portion of the retort by conventional means.

The retorted shale along with the spent shale serving as heat carrier is removed from the lower portion of the retort by conventional means at the retort temperature and fed to a lower portion of a combustor.

While the combustor may be of conventional design, it is preferred that it be a dilute phase lift combustor. Air is injected into the lower portion of the combustor and the organic residue on the shale is burned. The combustion heats the retorted shale to a temperature in the range of 600° C. to 800° C. and the hot shale and flue gas are removed from the upper portion of the combustor. A portion of the hot spent shale is recycled to provide heat for the retort. Preferably said recycled shale is classified to remove substantially all of the minus 200 mesh shale fines prior to introduction to the retort in order to minimize entrained fines carryover with the effluent product vapor.

SUMMARY OF THE INVENTION

There is provided in an improved staged turbulent bed retort system having a separate combustion zone for the retorted shale and using spent shale as a heat transfer material, the improvement comprising:

classifying and deaerating the raw shale feed into a first fraction and a second fraction, said first fraction containing substantially only raw shale particles sized above about 20–30 mesh, and preferably above about 25 mesh;

preheating said first fraction to a temperature in the range 150° to 370° C. with hot spent shale particles ranging from about 10–500 microns in a dilute phase lift line;

separating the preheated raw shale particles from the spent shale particles; and feeding the preheated raw shale and the second fraction to the retort.

Deaerating the said first fraction of the raw shale may be advantageously accomplished simultaneously in a cyclone or impactor using an oxygen free gas as the carrier gas.

DETAILED DESCRIPTION OF THE DRAWING

Raw crushed shale, nominally 2½ mesh, Tyler Standard Sieve Size, or smaller, is introduced through line 10 into a first classification zone 20. In zone 20, the raw shale is separated or classified into a first shale fraction 30 and a second shale fraction 40. Shale fraction 30 preferably comprises only shale particles greater than 20 mesh in size, and more preferably greater than 25 mesh. Shale fraction 40 preferably comprises shale particles smaller than 20 mesh in size, and more preferably smaller than 25 mesh.

A size separation of this nature may be conveniently conducted using conventional means such as cyclones, impactor separators, and the like. Preferably, recycle gas, flue gas, steam or any gas substantially free of oxygen is used to pneumatically convey the shale through line 10 to one or more cyclones in classification zone 20. Deaeration of the shale is desirable to avoid product combustion and is preferably conducted prior to introducing the shale to the preheater.

Shale fraction 30 is fed by conventional means from zone 20 to the bottom of a lift line, or a cocurrent direct contact heat exchanger 50. Steam and hot entrained shale ash at a temperature of about 650°–800° C., preferably 700°–760° C., are also injected in the bottom of the exchanger through lines 55 and 60 respectively. Sufficient quantities of steam are used to insure a gas velocity in the exchanger or preheater, which is approximately 10 percent greater than the terminal velocity of the largest shale particles. The entrained hot shale fines will normally be sized in the range of 10–500μ, and more preferably in the range of 20 to 100μ. Preferably ½ to 1 kg of hot shale fines will be admitted to the preheater per kg of fresh raw shale fed to the preheater. The preheater will normally provide a residence time of approximately 1–15 seconds for the shale particles, depending upon the size of the particles. The raw shale is rapidly heated to a temperature of 150°–370° C., preferably 320° C.

Spent shale fines, preheated raw shale and steam exit from the top of preheater 50 via line 70 and pass to separation zone 80. In zone 80, which may comprise conventional separator means such as cyclones, impact separators, etc., the spent shale fines are separated from the preheated raw shale and said fines pass via line 90 to a cleanup system 100 for recovery of the lift gas 120.

The preheated raw shale is transferred from separation zone 80 to the top portion of staged turbulent bed retort 140 through line 130.

Shale fraction 40 is also introduced to the top portion of retort 140, preferably below the introduction point of the preheated raw shale, although both shale fractions may be introduced at the same point.

Hot spent shale at a temperature in the range of 600°–800° C., preferably 700°–760° C., from the combustor is added to the top of the retort via line 150 to provide the heat for pyrolyzing the raw shale. The spent shale will normally be classified and comprise shale particles in the range of plus 200 to minus 2½ mesh in size. Since a portion of the raw shale has been preheated, a much lower recycle ratio of spent shale to raw shale is required to maintain the desired retort temperature. A lower ratio of spent to raw shale is particularly desirable, especially in view of the higher product yield attainable at the lower ratios and the high attrition rate of the richer grade shales. By preheating the 25 mesh plus raw shale to 320° C., a recycle ratio as low as 1.8 may be used when operating the retort at the preferred temperature of 500° C. and the combustor at 760° C. Lower recycle ratios also result in lower total mass flow rates which, of course, reduce the size of the retort volume required for a given raw shale throughput.

A stripping gas, preferably steam, is introduced via line 160 into a lower portion of the retort and passes upwardly through the vessel in countercurrent flow to the downwardly moving shale. Advantageously, a portion of this stripping gas can be obtained from the preheater carrier gas after the solids have been substantially removed in zone 100. The flow rate of the stripping gas should be regulated to produce a superficial gas velocity at the bottom of the vessel in the range of approximately 30 cm/sec to 150 cm/sec, with a preferred superficial velocity in the range of 30 cm/sec to 60 cm/sec.

The stripping gas will fluidize those solids having a minimum fluidization velocity less than the velocity of the stripping gas. Those particles having a fluidization velocity greater than the gas velocity will pass downwardly through the retort, generally at a faster rate than the fluidized particles. An essential feature of the staged turbulent bed retort lies in limiting the maximum bubble size and the vertical backmixing of the downwardly moving solids to produce stable, substantially plug flow conditions throughout the retort volume. True plug flow, wherein there is little or no vertical backmixing of solids, allows much higher conversion levels of kerogen to vaporized hydrocarbonaceous material than can be obtained, for example, in a fluidized bed retort with gross top to bottom mixing. The means for limiting backmixing and limiting the maximum bubble size, indicated by reference numeral 260, may be generally described as barriers, baffles, dispersers or flow redistributors, and may, for example, include spaced horizontal perforated plates, bars, screens, packing, or other suitable internals.

Gross vertical backmixing should be avoided, but highly localized mixing is desirable for purposes of heat transfer in that it increases the degree of contacting between the solids and the solids and gases. The degree of backmixing is, of course, dependent on many factors, but is primarily dependent upon the particular internals or packing disposed within the retort.

A product effluent stream comprised of hydrocarbonaceous material and entrained fines admixed with the stripping gas is removed from the upper portion of the retort by conventional means through line 170.

As the raw oil shale is pyrolyzed in the retort, the kerogen is decomposed and driven off in the vapor state, leaving an organic residue on the mineral structure. The amount of carbonaceous matter remaining is dependent upon various factors, but at the temperatures required for commercial retorting, the primary factor is the grade or richness of the raw oil shale. When Green River kerogen is pyrolyzed at 500° C., it yields approximately 62 weight percent oil, 13 weight percent gas, 8 weight percent water, and 17 weight percent carbon residue.

The retorted shale and the spent shale, serving as heat carrier, is removed from the lower portion of the retort via line 180 by conventional means at the retort temperature. From line 180 the solids are fed to a lower portion of combustor 190.

While combustor 190 may be of conventional design, it is preferred that it be a dilute phase lift combustor. Air is injected into the lower portion of the combustor via line 200 and the organic residue on the shale is burned.

The combustion heats the retorted shale to a temperature in the range of 600° C. to 800° C. and the hot shale and flue gas are removed from the upper portion of the combustor via line 210 and passed to separation zone 220. A portion of the hot spent shale is recycled from separation zone 220 via line 150 to provide heat for the retort. Preferably said recycled shale is classified to remove substantially all of the minus 200 mesh shale fines prior to introduction to the retort in order to minimize entrained fines carryover in the effluent product vapor. Hot flue gases are removed from the separation zone via line 230; hot fines, ranging in size from 10–500$\mu$, via line 60; and excess spent solids are passed from the zone via line 240.

What is claimed is:

1. In an improved process for retorting oil shale wherein spent shale particles at an elevated temperature and raw shale particles are introduced into an upper portion of a vertically elongated retort using a staged turbulent bed; a non-oxidizing fluidization gas is passed upwardly through the retort at a velocity in the range of 30–150 centimeters per second; the size of both said raw shale particles and said spent shale particles is maintained in a range which includes particles which are fluidizable at said gas velocity and particles which are non-fluidizable at said gas velocity; the raw shale particles and the spent shale particles pass downwardly through said retort whereby the raw shale is heated to retorting temperature evolving hydrocarbonaceous vapors; the hydrocarbonaceous vapors are withdrawn from an upper portion of the retort with the fluidization gas; retorted shale particles and spent shale particles are withdrawn from a lower portion of the retort, and are fed to a separate combustion zone with oxygen to burn residual carbon thereon and provide hot spent shale particles, the improvement comprising:

classifying and deaerating the raw shale particles into a first fraction and a second fraction, said first fraction containing substantially only raw shale particles sized above about 30 mesh;

preheating said first fraction to a temperature in the range 150°–370° C. with hot spent shale fines, ranging from about 10–500$\mu$, in a dilute phase lift line;

separating the preheated first fraction from the spent shale fines; and feeding the preheated first fraction and the second fraction to the retort.

2. An improved process as recited in claim 1, wherein said first fraction contains substantially only raw shale particles sized above about 25 mesh.

3. An improved process as recited in claim 1, wherein said classification and deaeration of the raw shale particles are accomplished in a cyclone using a substantially oxygen free gas as the carrier gas.

4. An improved process as recited in claim 1, wherein said classification and deaeration of the raw shale particles are accomplished in an impactor separator using a substantially oxygen free gas as the carrier gas.

5. An improved process as recited in claim 1, wherein said first fraction is preheated to a temperature of approximately 320° C.

6. An improved process as recited in claim 1, wherein the preheated first fraction is introduced to the retort at a level higher than the level of introduction of the second fraction.

7. An improved process as recited in claim 1, wherein steam is used as the carrier gas in the dilute phase lift line.

8. An improved process as recited in claim 7, further comprising:

recovering the steam from the dilute phase lift line substantially free of solids; and using said recovered steam as a portion of the fluidization gas.

* * * * *